US007704350B2

(12) United States Patent
Hikita et al.

(10) Patent No.: US 7,704,350 B2
(45) Date of Patent: Apr. 27, 2010

(54) PRESS BELT AND SHOE PRESS ROLL

(75) Inventors: Takahisa Hikita, Yawata (JP); Atsuo Watanabe, Hirakata (JP)

(73) Assignee: Yamauchi Corporation, Osaka (JP)

( * ) Notice: Subject to any disclaimer, the term of this patent is extended or adjusted under 35 U.S.C. 154(b) by 356 days.

(21) Appl. No.: 10/571,228

(22) PCT Filed: Sep. 1, 2004

(86) PCT No.: PCT/JP2004/012631

§ 371 (c)(1),
(2), (4) Date: Mar. 6, 2006

(87) PCT Pub. No.: WO2005/024128

PCT Pub. Date: Mar. 17, 2005

(65) Prior Publication Data

US 2007/0023156 A1 Feb. 1, 2007

(30) Foreign Application Priority Data

Sep. 4, 2003 (JP) ..... 2003-313000
Oct. 23, 2003 (JP) ..... 2003-363656

(51) Int. Cl.
*D21F 3/02* (2006.01)
*B30B 3/02* (2006.01)
*B30B 5/04* (2006.01)

(52) U.S. Cl. ..... 162/358.4; 162/358.3; 162/901; 100/153; 492/20

(58) Field of Classification Search ..... 162/204, 162/205, 358.1, 358.3, 358.4, 901; 100/153, 100/156; 492/20, 48, 28, 30, 31, 33–37
See application file for complete search history.

(56) References Cited

U.S. PATENT DOCUMENTS

| | | | | |
|---|---|---|---|---|
| 4,330,023 | A * | 5/1982 | Cronin | 162/358.4 |
| 4,944,844 | A * | 7/1990 | Marcinko | 162/205 |
| 5,766,421 | A * | 6/1998 | Aufrecht | 162/358.4 |
| 5,943,951 | A | 8/1999 | Muellner et al. | |
| 6,030,503 | A | 2/2000 | Matuschczyk | |
| 6,736,939 | B2 | 5/2004 | Watanabe | |
| 2003/0024677 | A1 * | 2/2003 | Watanabe | 162/358.3 |

FOREIGN PATENT DOCUMENTS

| | | |
|---|---|---|
| DE | 4445472 | 6/1996 |
| EP | 0829573 | 3/1998 |
| EP | 0886004 | 12/1998 |
| EP | 0978588 | 2/2000 |
| EP | 04772587 | 2/2007 |
| JP | 61179359 | 8/1986 |
| JP | 08-013373 | * 1/1996 |
| JP | 10298893 | 11/1998 |

(Continued)

*Primary Examiner*—Eric Hug
(74) *Attorney, Agent, or Firm*—Ditthavong Mori & Steiner, P.C.

(57) ABSTRACT

A press belt (2) comprises both-end corresponding regions B positioned so as to correspond to both ends of a press roll (1) or a press shoe (3) in a width direction and having a small thickness and a center region A positioned between the both-end corresponding regions B and having a thickness larger than that of the both-end corresponding region B.

18 Claims, 4 Drawing Sheets

FOREIGN PATENT DOCUMENTS

| | | |
|---|---|---|
| JP | 11012975 | 1/1999 |
| JP | 2000110090 | 4/2000 |
| JP | 2002180393 | 6/2002 |
| JP | 2002327389 | 11/2002 |
| WO | PCT/JP2004/012631 | 7/2006 |

* cited by examiner

PRESS BELT AND SHOE PRESS ROLL

TECHNICAL FIELD

The present invention relates to a press belt and shoe press roll used to press an object in various kinds of industries such as a paper industry, a magnetic recording medium manufacturing industry, a fiber industry and the like.

BACKGROUND ART

In various kinds of industries, belt press in which a continuous long object to be pressed is put on a press belt and the object is pressed between one press member positioned inside the press belt and the other press member positioned outside the press belt is used. Here, the press member is a press roll or a press shoe. As an example of the belt press, there is a shoe press as dewatering press in the paper industry.

The shoe press will be briefly described taking the paper industry as an example. It is a pressing (drying) method in which an object (wet paper web) to be pressed is put on an outer peripheral surface of a press belt and pressed between a press roll positioned outside the press belt and serving as external pressing means and a press shoe positioned inside the press belt and serving as internal pressing means, through the press belt. While linear pressure is applied to the object to be pressed in roll press using two rolls, area pressure can be applied to the object to be pressed by using a press shoe having a predetermined width in a travel direction in the shoe press. Therefore, when the dewatering press is performed by the shoe press, a nip width can be increased and a dewatering effect can be enhanced.

In order to make the shoe press compact, as disclosed in Japanese Unexamined Patent Publication No. 61-179359, for example, a shoe press roll in which a press shoe serving as internal pressing means is covered with a cylindrical flexible press belt (press jacket) has been widely used.

Other than the above dewatering process, in the paper industry, the magnetic recording medium manufacturing industry, the fiber industry and the like, the shoe press is performed instead of the roll press or together with the roll press in order to improve quality of an object to be pressed like a calendaring process in which a surface of the object to be pressed is smoothed and glossed. General required characteristics of the press belt includes strength, abrasion resistance, flexibility, impermeability to water, oil, gas and the like. As a material having the above characteristics, polyurethane which is provided by reacting urethane prepolymer with a curing agent is used in the press belt in general. However, since excessive bending or pressing is repeated on the press belt, especially the shoe press belt, a crack which is likely to be generated in the outer peripheral surface is a big problem in view of resistance.

As a method of solving the above problem, Japanese Unexamined Patent Publication No. 10-298893 discloses a shoe press belt in which abrasion resistance and crack resistance is improved by differentiating hardness of a resin which constitutes the belt so as to be high in a center region and low in both edge regions containing parts corresponding to shoe edges in a width direction. In this case, it is thought that there is an effect that the abrasion resistance or pressed deformation resistance is maintained in the center region and the crack is not easily generated in both edge regions.

The crack is likely to be generated intensively in both-end corresponding regions which correspond to both ends of the pressing means in the width direction such as the press roll or the press shoe. Thus, it is thought that the crack resistance is not needed so much in the center region positioned between the both-end corresponding regions and serving as a pressing surface of the object to be pressed, but the abrasion resistance or the pressed deformation resistance should be concerned in the center region.

Although a patent document 2 (Japanese Unexamined Patent Publication No. 10-298893) is provided based on the above thought, in order to satisfy both of the abrasion resistance and the crack resistance by differentiating hardness, it is necessary to largely differentiate the hardness of the center region from that of both edge regions. When the hardness of polyurethane is differentiated, contractive force at the time of processing is varied. Therefore, according to the belt in which the hardness in the center region is largely differentiated from that in both edge regions in the width direction, cylindricality is lowered and traveling performance could be lowered.

In another prior art document, a crack is prevented from being generated in both-end corresponding regions which correspond to both ends of pressing means by improving a configuration or a structure of a press belt or differentiating a depth of a drainage groove (water-squeeze groove). For example, according to Japanese Unexamined Patent Publication No. 2002-180393, a thickness of a middle layer of a press belt positioned so as to correspond to both ends of pressing means in a width direction is increased. In addition, according to Japanese Unexamined Patent Publication No. 2002-327389, a bottom of a drainage groove positioned so as to correspond to both ends of pressing means in a width direction is brought to come close to a reinforcing layer of a middle layer. According to U.S. Pat. No. 5,943,951, flexibility is enhanced by varying a thickness of both ends of a press belt in a width direction gradually. According to U.S. Pat. No. 6,030,503, many recessed parts which are different from grooves are provided in both ends of a press belt in a width direction. According to Japanese Unexamined Patent Publication No. 11-12975, a depth of a drainage groove in both ends of a press belt in a width direction is reduced.

DISCLOSURE OF THE INVENTION

It is an object of the present invention to provide a press belt having a more simple structure than before, in which a crack is effectively prevented from being generated in both-end corresponding regions positioned so as to correspond to both ends of a press member in a width direction such as a press roll or a press shoe.

It is another object of the present invention to provide a shoe press roll using the press belt as an external cylinder.

The press belt according to the present invention has an endless configuration to be rotated, and it is used in a method in which an object to be pressed is put on an outer peripheral surface of the press belt and the object is pressed by pressing means positioned inside and/or outside the press belt and having a predetermined width. The press belt comprises both-end corresponding regions positioned so as to correspond to both ends of the pressing means in the width direction and having a small thickness and a center region positioned between the both-end corresponding regions and having a thickness larger than that of the both-end corresponding region.

Stress is applied to the both-end corresponding regions of the press belt in traveling and width directions, so that twisting stress is applied thereto. According to the constitution of the present invention, since the thickness of the both-end corresponding region is small, flexibility in this region is enhanced. Therefore, when the twisting stress is applied to the both-end corresponding region, since the both-end corresponding region absorbs the twisting stress by flexible deforming, the crack is effectively prevented from being generated.

In addition, the terms "travel direction" and "width direction" used in this specification means a travel direction and a width direction of the object to be pressed, respectively unless otherwise noted. In addition, the object to be pressed is a continuous long material such as a wet paper web, a magnetic tape, a cloth and the like, which is not particularly limited. In addition, the pressing means includes the press roll or the press shoe.

According to one embodiment, an outermost region having the same thickness as that of the center region is provided outside the both-end corresponding region. In general, a felt is placed between the press belt and the object to be pressed and the object passes through the pressing means together with the felt. When the outermost region of the press belt has the same thickness as that of the center region, since both ends of the felt in a width direction can be stably supported, free movement of the felt can be controlled.

For example, the press belt comprises a reinforcing layer and an upper elastic layer formed thereon. In this case, a circular recessed part is provided in the both-end corresponding region of the upper elastic layer. Preferably, both opposed sidewall surfaces of the recessed part are tapered so that a distance between them is reduced toward a lower side. Although there is a case where drainage grooves extending along a belt travel direction are spirally formed in the upper elastic layer of the press belt, when both sidewall surfaces of the recessed part are perpendicular wall surfaces, an intersecting part with the drainage groove could be a steep edge. In order to prevent such steep edge from being generated, both sidewall surfaces are preferably tapered. The reinforcing base material in the reinforcing layer is a woven cloth, for example.

As describe above, many drainage grooves extending along the travel direction of the belt may be formed in the outer peripheral surface of the upper elastic layer. In this case, preferably, a bottom surface of the recessed part is deeper than a bottom end of the drainage groove. It is highly likely that a crack is generated in the bottom of the drainage groove positioned in the both-end corresponding region of the press belt. According to this embodiment, since the thickness of the both-end corresponding region is small and the drainage groove is not formed in this region, the crack is effectively prevented from being generated.

When the press belt comprises the outermost region having the same thickness as that of the center region outside the both end corresponding region, many drainage grooves may be formed in outer peripheral surfaces of the center region and the outermost region along the travel direction of the belt. When the drainage grooves are provided in the outermost region, since flexibility of the outermost region can be enhanced, an effect of preventing the crack generation can be enhanced.

A press belt according to another embodiment comprises a reinforcing layer and an upper elastic layer formed thereon. Both ends of the upper elastic layer are positioned at a boundary part between the center region and the both-end corresponding region. Preferably, both ends of the upper elastic layer are gently curved slant surfaces.

A press belt according to still another embodiment comprises a reinforcing layer and an upper elastic layer formed thereon. The upper elastic layer has a tapered part in which a thickness is reduced outward in a width direction, on the both-end corresponding region. A recessed groove is formed in the middle of the tapered part so as to reduce its thickness. When many drainage grooves extending along a travel direction of the belt are formed in the outer peripheral surface of the upper elastic layer, it is preferable that the recessed groove is deeper than the drainage groove.

In another aspect of the present invention, a press belt comprises a reinforcing layer and an upper elastic layer formed on the reinforcing layer, and the upper elastic layer comprises both-end corresponding regions positioned so as to correspond to both ends of the pressing means in a width direction and a center region positioned between the both-end corresponding regions. This embodiment is characterized in that many drainage grooves extending along the travel direction of the belt are formed in the center region of the upper elastic layer but a drainage groove is not formed in the both-end corresponding region. The crack is easily generated in the bottom of the drainage groove positioned in the both-end corresponding region. Thus, according to this embodiment, the drainage groove is not formed in the both-end corresponding region to prevent the crack from being generated. In this embodiment, the thickness of the both-end corresponding region may be the same as that of the center region.

In the above embodiment, an outermost region having a drainage groove may be provided outside the both-end corresponding region. Since the flexibility of the outermost region is enhanced because of the drainage grooves in the outermost region, the crack is more effectively prevented from being generated.

A shoe press roll according to the present invention comprises an external cylinder comprising an endless press belt, and press shoe positioned inside the cylinder as pressing means.

BEST MODE FOR CARRYING OUT THE INVENTION

An embodiment of the present invention will be described with reference to the drawings hereinafter.

Figure 1:
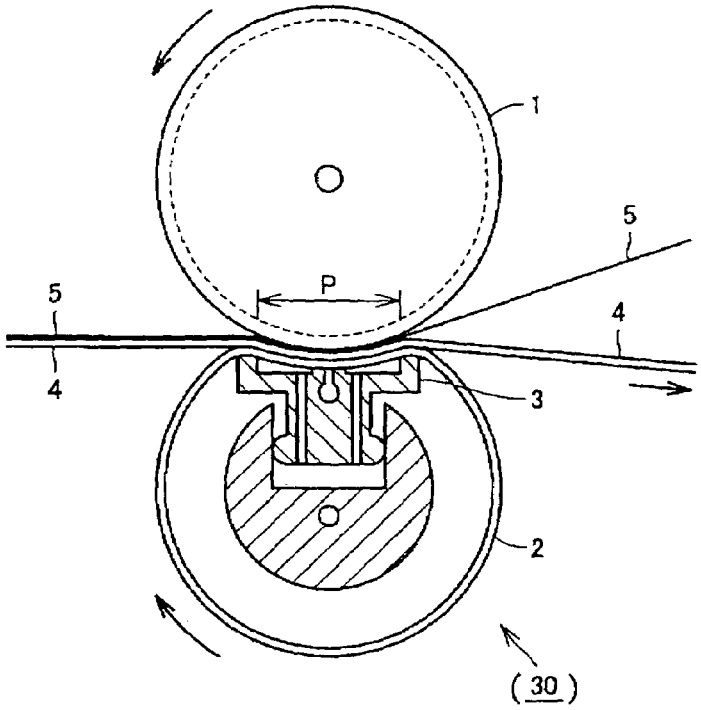
FIG. 1 is a sectional view showing a shoe press system in a travel direction used in a press process of a paper machine.

FIG. 1 is a view showing a section of a shoe press system in a travel direction used in a pressing process of a paper machine. The shoe press system comprises a press roll as pressing means 1, a press belt 2 opposed to the press roll 1, and a press shoe positioned inside the press belt 2 and serving as pressing means 3. In addition, according to the system shown in FIG. 1, although a shoe press roll 30 is so constituted that the press shoe 3 is covered with the press belt 2 and the press belt 2 is assembled so as to be in the shape of a roll as an external cylinder, the press belt 2 is not necessarily assembled so as to be in the shape of the roll and it may be used as an endless belt as it is.

A size of this kind of the press belt 2 is 2 to 15 m in width and 1 to 30 m in peripheral length and 2 to 10 mm in thickness in general.

The press roll 1 is positioned outside the press belt 2 and functions as one pressing means. The press shoe 3 is positioned inside the press belt 2 and functions as the other pressing means. A wet paper web 5 to be pressed on which a felt 4 is provided passes between the press belt 2 and the press roll 1. An outer periphery of the press belt 2 and the felt 4 are directly in contact with each other.

Lubricating oil is supplied between the press belt 2 and the press shoe 3 and the press belt 2 can slide on the press shoe 3. The press roll 1 is driven to be rotated and the press belt 2 is rotated by frictional force with the traveling felt 4, sliding on the press shoe 3.

The press shoe 3 is pressed from the inside of the press belt 2 toward the press roll 1 and the wet paper web 5 is pressed by this pressing force and dewatered. A surface of the press shoe 3 is recessed so as to correspond to a surface of the press roll 1. Thus, a pressing and dewatering part P having a large width in the travel direction is formed between the press roll 1 and the press belt 2.

Figure 2:
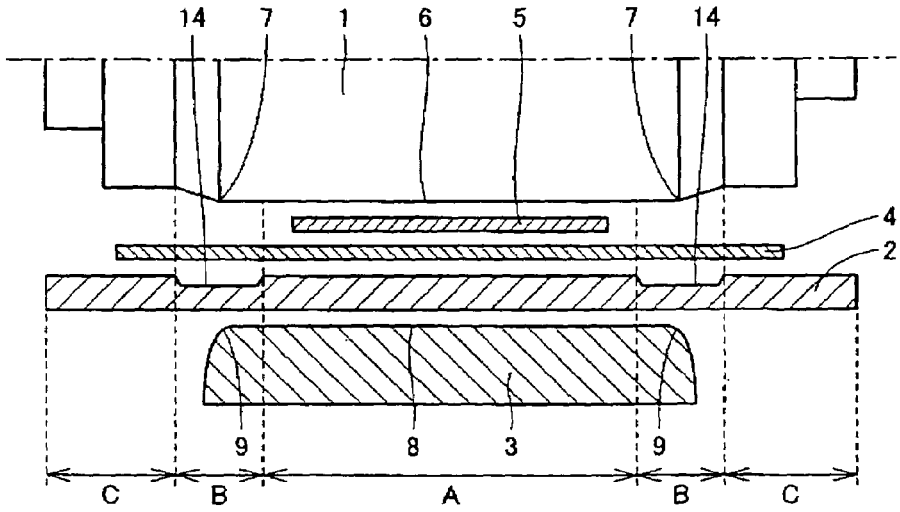
FIG. 2 is a sectional view showing an essential part of a pressing and dewatering part P in a width direction in FIG. 1.

FIG. 2 is a sectional view showing an essential part of the pressing and dewatering part P in a width direction in FIG. 1. As shown in FIG. 2, the press roll 1 and the press shoe 3 have predetermined lengths in the width direction. The press belt 2 comprises a center region A, both-end corresponding regions B, and outermost regions C. The both-end corresponding regions B correspond to regions comprising both ends 7 of a pressing surface 6 of the press roll 1 and both ends 9 of a pressing surface 8 of the press shoe 3. The outermost region C is positioned outside the both-end corresponding region B.

Figure 3:
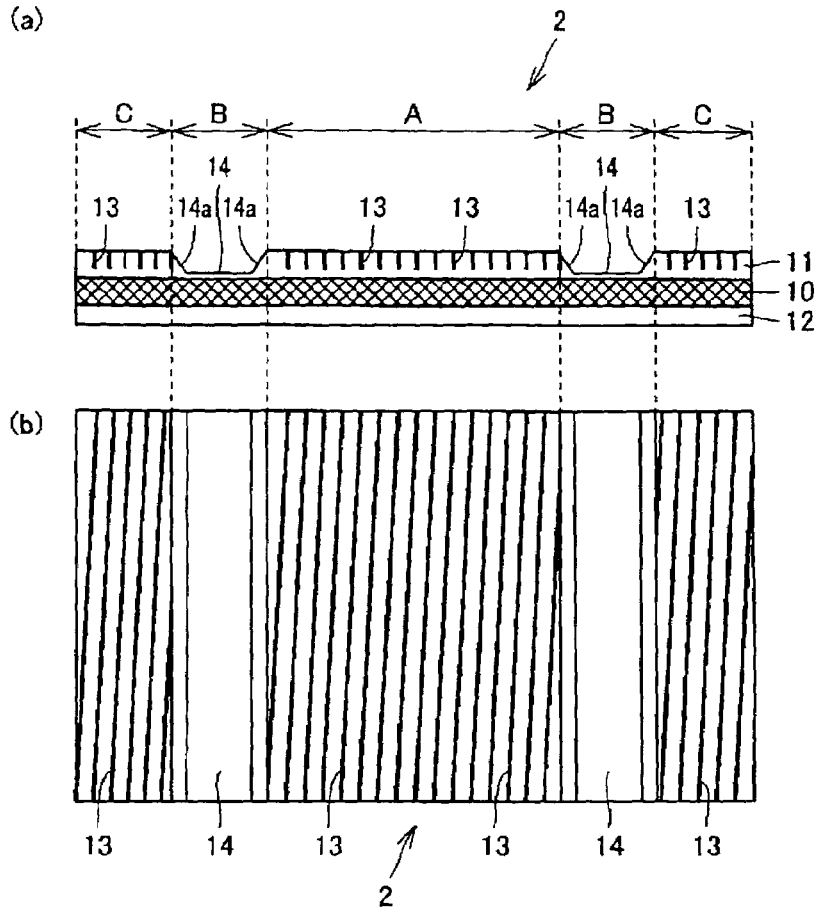
FIG. 3 are views showing a press belt according to one embodiment of the present invention, in which (a) shows its sectional view and (b) shows it plan view.

FIG. 3 are views showing an example of the press belt, in which FIG. 3(*a*) shows its sectional view and FIG. 3(*b*) shows its plan view. The press belt 2 comprises an endless reinforcing layer 10 in which an elastic material is impregnated in a reinforcing base material, an upper elastic layer positioned on an outer periphery of the reinforcing layer 10 and integrated with the elastic material impregnated in the reinforcing base material of the reinforcing layer 10, and an lower elastic layer 12 positioned on an inner periphery of the reinforcing layer 10 and integrated with the elastic material impregnated in the reinforcing base material of the reinforcing layer 10.

As the reinforcing base material constituting the reinforcing layer 10, a woven cloth comprising an organic fiber such as polyamide and polyester is used. The entire belt 2 is integrally formed of an elastic material such as thermosetting polyurethane and the reinforcing base material is buried in the belt 2.

As shown in FIG. 3, many drainage grooves 13 extending along the travel direction of the belt are provided in the outer peripheral surface of the upper elastic layer 11. The drainage groove 13 extends spirally in the press belt 2 throughout in the width direction.

Figure 4:
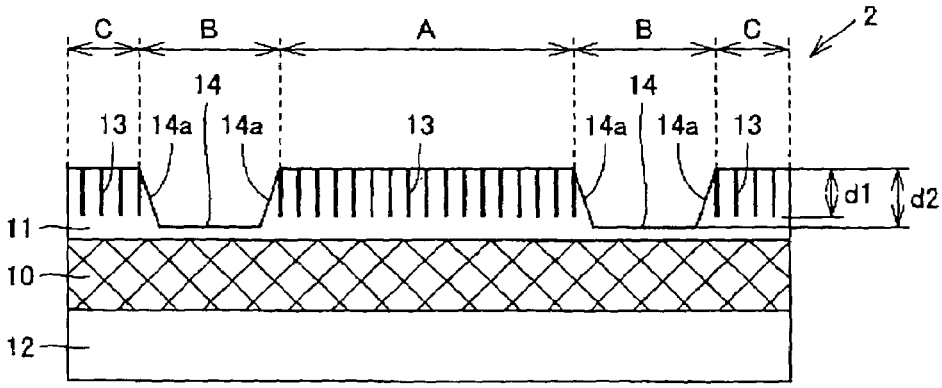
FIG. 4 is an enlarged sectional view showing one embodiment of the present invention.

FIG. 4 is an enlarged sectional view showing the press belt 2. In the press belt 2, a thickness of the both-end corresponding region B positioned so as to correspond to both ends of the pressing means in the width direction is constituted so as to be smaller than that of the center region A and the outermost region C. More specifically, according to the upper elastic layer 11, the both-end corresponding region B is a recessed part 14 which circularly extends in the belt travel direction, so that the thickness of the both-end corresponding region B is smaller than those of the other parts.

According to the embodiment shown in FIG. 4, when it is assumed that a depth of the drainage groove 13 is d1 and a depth of the recessed part 14 is d2, the depth of the drainage groove and the depth of the recessed part 14 are selected so as to satisfy that d2≧d1. In this dimensional relation, the drainage groove 13 is formed in the center region A and the outermost region C but the drainage groove is not formed in the both-end corresponding region B.

Here, concrete dimensions will be exemplified. As describe above, the press belt 2 is 2 to 15 m in its width, 1 to 30 m in peripheral length and 2 to 10 mm in thickness. According to such press belt 2, a width dimension of the both-end corresponding region B is about 2 to 15 cm, a thickness of the upper elastic layer 11 is about 1.2 to 3 mm, the depth d1 of the drainage groove 13 is about 0.5 to 1.5 mm, and the depth d2 of the recessed part 14 is about 1.2 to 3 mm. In addition, a width of the drainage groove 13 is about 0.6 to 1.2 mm and a width of a land part positioned between the adjacent drainage grooves 13 is about 0.9 to 3.6 mm.

According to the embodiment shown in FIG. 4, the following advantages are provided. First, since the thickness of the both-end corresponding region B is reduced, flexibility of this region can be improved. Therefore, even when twisting stress is applied to this region, since the twisting stress can be absorbed by its flexible deformation to some extent, a crack can be prevented from being generated.

Secondly, since the recessed part 14 is formed in the upper elastic layer positioned in the both-end corresponding region B, there is no drainage groove in which the crack is likely to be generated, so that an effect to prevent the crack generation is highly provided. Preferably, both sidewall surfaces 14*a* of the recessed part 14 are tapered so that a distance between them is decreased toward the bottom. If both sidewall surfaces 14*a* of the recessed part 14 are perpendicular wall surfaces, an intersecting part between the perpendicular surface and the drainage groove 13 could be a steep edge. In order to prevent such steep edge from being generated, both sidewall surfaces 14*a* are preferably tapered. In addition, in order to avoid stress concentration in a bottom corner part of the recessed part 14, the corner part may be curved.

Thirdly, since the outermost region C of the press belt 2 has the same thickness as that of the center region A, both ends of the felt in the width direction can be stably supported by the outermost regions C, so that free movement of the felt can be controlled.

Fourthly, since the many drainage grooves are formed in the outer peripheral surfaces of the outermost region C along the travel direction of the belt, the flexibility of the outermost region C is enhanced, so that the effect to prevent the generation of the crack is improved.

FIGS. 5, 6, 7, 8 and 9 show other embodiments of the press belt.

Figure 5:
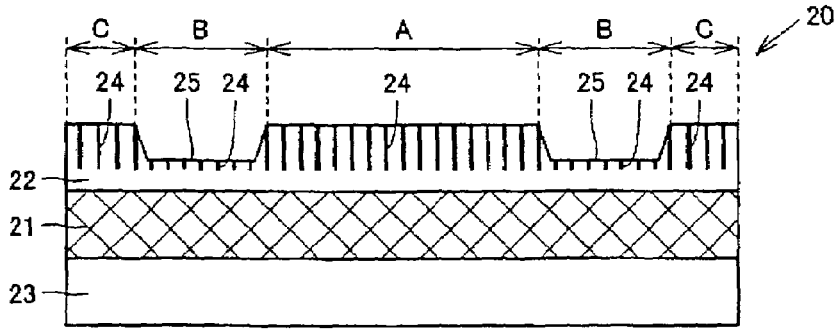
FIG. 5 is an enlarged sectional view showing another embodiment of the present invention.

A press belt 20 shown in FIG. 5 comprises a reinforcing layer 21, an upper elastic layer 22 and a lower elastic layer 23. According to this embodiment, drainage grooves 24 spirally extend in the upper elastic layer 22 throughout in a width direction. A part corresponding to both-end corresponding region B in the upper elastic layer 22 is a recessed part 25. A depth of the recessed part 25 is smaller than that of the drainage groove 24. Thus, the drainage groove 24 is provided in the bottom of the recessed part 25. According to this embodiment also, since the both-end corresponding region B having a small thickness provides preferable flexibility, the crack can be prevented from being generated.

Figure 6:
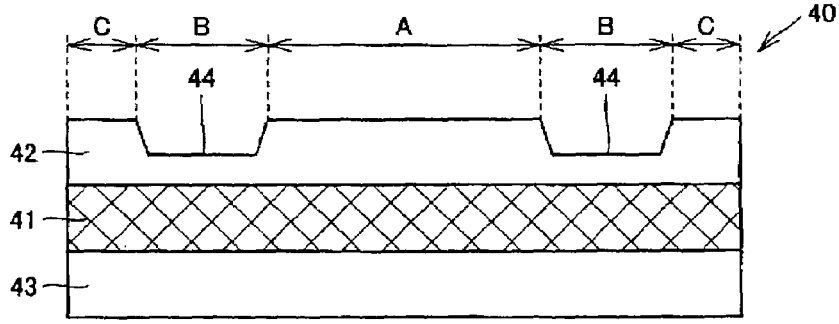
FIG. 6 is an enlarged sectional view showing still another embodiment of the present invention.

A press belt 40 shown in FIG. 6 comprises a reinforcing layer 41, an upper elastic layer 42 and a lower elastic layer 43. According to this embodiment, there is no drainage groove provided. Since a part corresponding to a both-end corresponding region B in the upper elastic layer 42 is a recessed part 44, the both-end corresponding region B provides preferable flexibility.

Figure 7:
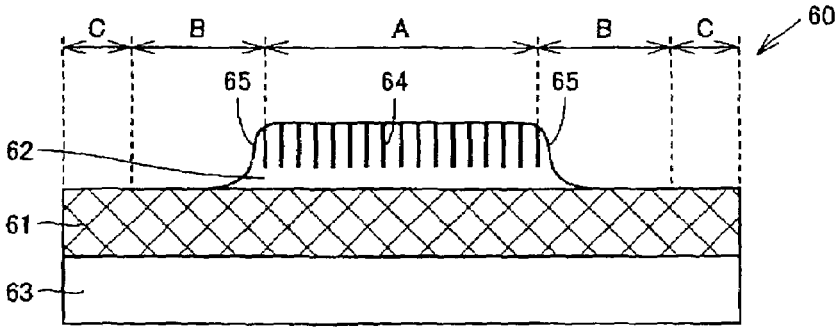
FIG. 7 is an enlarged sectional view showing still another embodiment of the present invention.

A press belt 60 shown in FIG. 7 comprises a reinforcing layer 61, an upper elastic layer 62 and a lower elastic layer 63. Drainage grooves 64 spirally extend in the upper elastic layer 62 throughout in a width direction. According to this embodiment, almost no upper elastic layer is formed on a both-end corresponding region B and an outermost region C, so that the both-end corresponding region B and the outermost region C are provided substantially on the same surface as the reinforcing layer 61. Here, the term "substantially on the same surface" includes a concept such that even if the upper elastic layer is remained, it is a skin layer which is 0.5 mm or less in thickness. In addition, both ends 65 of the upper elastic layer 62 positioned at a boundary part between a center region A and the both-end corresponding region B are gently curved slant surfaces. Especially, upper and lower corner parts of the upper elastic layer are chamfered so as to be gently curved to avoid stress concentration.

Figure 8:
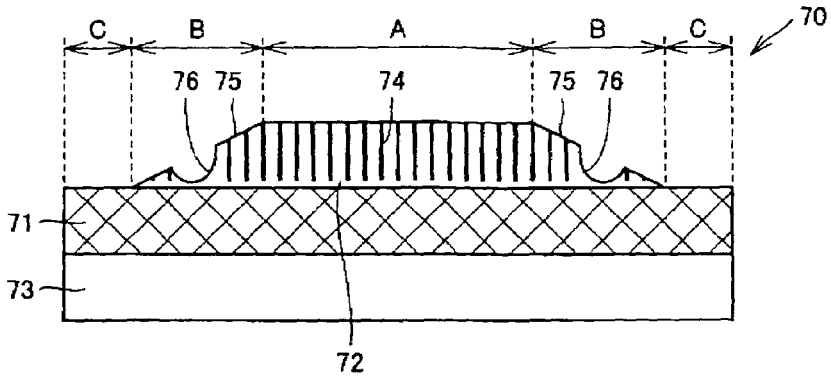
FIG. 8 is an enlarged sectional view showing still another embodiment of the present invention.

A press belt 70 shown in FIG. 8 comprises a reinforcing layer 71, an upper elastic layer 72 and a lower elastic layer 73. Drainage grooves 74 spirally extend in the upper elastic layer 72 throughout in the width direction. According to this embodiment, the upper elastic layer is hardly formed on an outermost region C and the outermost region C is provided on the substantially same surface as the reinforcing layer 71. In addition, the upper elastic layer 72 positioned on a both-end corresponding region B has a tapered part 75 in which its thickness is gradually reduced toward the outermost region C. As shown in FIG. 8, a recessed groove 76 which is deeper than the drainage groove 74 is formed in the middle of the tapered part 75. The tapered part 75 which reduces in thickness functions to absorb stress. In addition, since there is no drainage groove in which the crack is likely to be generated provided in the recessed groove 76, the crack can be prevented from being generated in this part. In addition, a width of the recessed groove 76 is about 1 to 10 cm.

Figure 9:
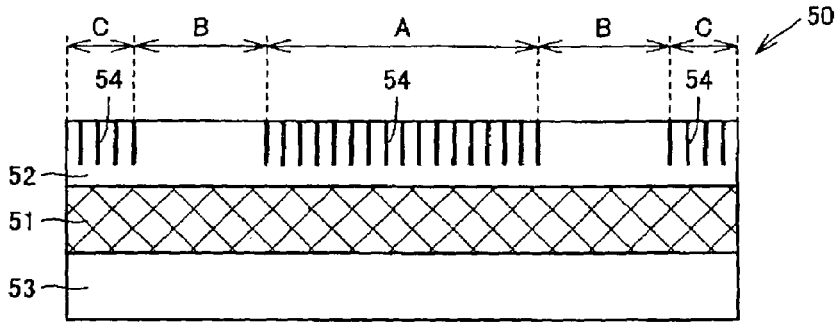
FIG. 9 is an enlarged sectional view showing still another embodiment of the present invention.

A press belt 50 shown in FIG. 9 comprises a reinforcing layer 51, an upper elastic layer 52 and a lower elastic layer 53. According to this embodiment, a recessed part is not formed. The upper elastic layer 52 comprises both-end corresponding regions B positioned so as to correspond to both ends of the pressing means in a width direction, a center region A positioned between the both-end corresponding regions B, and outermost regions C positioned outside the both-end corresponding regions B. Although many drainage grooves 54 extending along a belt travel direction are formed in the center region A and the outermost region C of the upper elastic layer 52, the drainage groove is not formed in the both-end corresponding region B. According to this embodiment, since the drainage groove in which the crack is likely to be generated is not formed in the both-end corresponding region B, the crack is prevented from being generated in this region.

Figure 10:
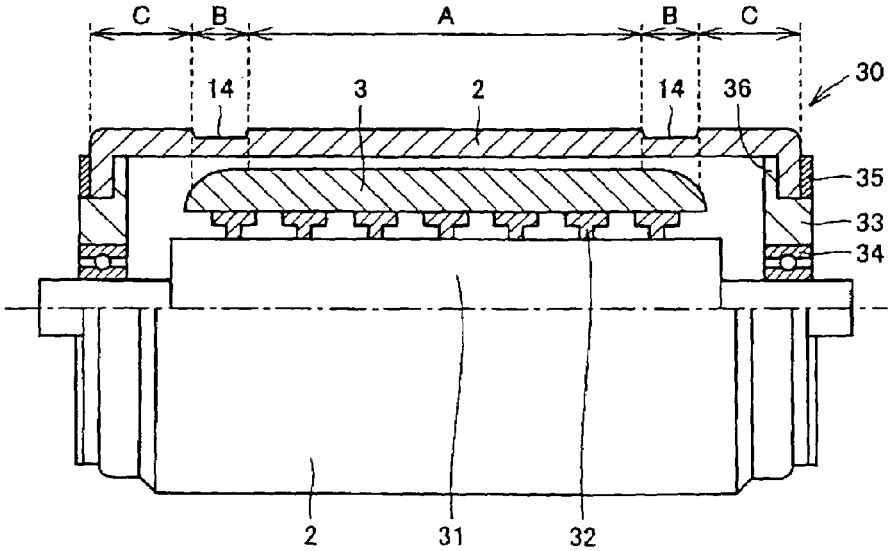
FIG. 10 is a sectional view showing a shoe press roll in a width direction according to one embodiment of the present invention.

Next, an embodiment of the shoe press roll 30 according to the present invention will be described with reference to FIG. 10. FIG. 10 is a sectional view showing the shoe press roll in a width direction. The shoe press roll 30 is constituted such that the press shoe 3 is covered with the press belt 2 serving as the pressing means and the press belt 2 is assembled so as to be in the shape of a roll as an external cylinder.

The press shoe 3 is supported by a hydraulic cylinder 32 on a supporting axis 31 and it can press the press belt 2 upward. An end disk 33 is rotatably supported on each end of the supporting axis 31 through a bearing 34. An edge of the press belt 2 is bent on an outer periphery 36 of the end disk 33 inside in a radius direction. The bent part of the edge of the press belt 2 is sandwiched between an outer periphery of the end disk 33 and a ring-shaped fix plate 35 and fixed by a screw bolt and the like. Lubricant oil is supplied between the press belt 2 and press shoe 3. Thus, the press belt 2 fixed to the end disk 33 can be rotated, sliding on the press shoe 3.

As the press belt 2, the press belt 2 described in the above embodiments can be used.

Although embodiments of the present invention have been described with reference to the drawings, the present invention is not limited to the illustrated embodiments. Various kinds of modifications and variations can be added in the same or the equivalent scope of the present invention.

INDUSTRIAL APPLICABILITY

The press belt according to the present invention can be used over a long period of time because a crack is not likely to be generated in a both-end corresponding region in which the crack is likely to be generated before. Therefore, the present invention can be advantageously applied to a press belt and shoe press roll used to press a material to be pressed in various kinds of industries such as a paper industry, a magnetic recording medium manufacturing industry, a fiber industry and the like.

The invention claimed is:

1. A shoe press roll comprising:

an external cylinder comprising an endless press belt; and a press shoe positioned inside said external cylinder, wherein said endless press belt comprises:

both-end corresponding regions positioned on both ends of said press shoe in a width direction and having a small thickness;

a center region positioned between said both-end corresponding regions and having a thickness larger than that of said both-end corresponding regions; and corresponding boundary parts positioned between said both-end corresponding regions and said center region, wherein drainage grooves extending along a travel direction of the endless press belt are formed at the center region, and wherein said drainage grooves are not formed at the both-end corresponding regions, and wherein said press shoe exerts pressure across said center region, said corresponding boundary parts, and at least some of said both-end corresponding regions in the width direction.

2. The shoe press roll according to claim 1, comprising an outermost region positioned outside said both-end corresponding region and having the same thickness as that of said center region.

3. The shoe press roll according to claim 1, wherein said endless press belt comprises a reinforcing layer and an upper elastic layer formed thereon, wherein said both-end corresponding region in said upper elastic layer is a circular recessed part.

4. The shoe press roll according to claim 3, wherein both opposed sidewall surfaces of said recessed part are tapered so that a distance between them is reduced toward a lower side.

5. The shoe press roll according to claim 3, wherein said reinforcing layer comprises a woven cloth.

6. The shoe press roll according to claim 3, wherein said drainage grooves extending along the travel direction of the belt are formed in the outer peripheral surface of said upper elastic layer.

7. The shoe press roll according to claim 6, wherein a bottom surface of said recessed part is at the same level as or deeper than a bottom end of said drainage groove.

8. The shoe press roll according to claim 2, wherein said drainage grooves are formed in outer peripheral surfaces of said center region and said outermost region along the travel direction of the belt.

9. The shoe press roll according to claim 1, wherein said endless press belt comprises a reinforcing layer and an upper elastic layer formed thereon, wherein both ends of said upper elastic layer are positioned at a boundary part between said center region and said both-end corresponding region.

10. The shoe press roll according to claim 9, wherein both ends of said upper elastic layer is a gently curved slant surface.

11. The shoe press roll according to claim 1, wherein said endless press belt comprises a reinforcing layer and an upper elastic layer formed thereon, wherein said upper elastic layer has a tapered part in which a thickness is reduced outward in a width direction, on said both-end corresponding region, and a recessed groove is formed in the middle of said tapered part.

12. The shoe press roll according to claim 11, wherein said drainage grooves extending along the travel direction of the belt are formed in an outer peripheral surface of said upper elastic layer, and said recessed groove is deeper than said drainage groove.

13. A press belt in a press system comprising a rotating endless press belt and pressing means positioned inside and/or outside said press belt, comprising:

both-end corresponding regions positioned so as to correspond to both ends of said pressing means in a width direction and having a small thickness;

a center region positioned between said both-end corresponding regions and having a thickness larger than that of said both-end corresponding region; and a reinforcing layer and an upper elastic layer formed thereon, wherein both ends of said upper elastic layer are positioned at a boundary part between said center region and said both-end corresponding region, and wherein both ends of said upper elastic layer is a gently curved slant surface.

14. A press belt in a press system comprising a rotating endless press belt and a press shoe positioned inside said press belt, comprising:

both-end corresponding regions positioned so as to correspond to both ends of said press shoe in a width direction and having a small thickness;

a center region positioned between said both-end corresponding regions and having a thickness larger than that of said both-end corresponding regions;

corresponding boundary parts positioned between said both-end corresponding regions and said center region; and a reinforcing layer and an upper elastic layer formed thereon, wherein said both-end corresponding region in said upper elastic layer is a circular recessed part, and wherein said press shoe exerts pressure across said center region, said corresponding boundary parts, and at least some of said both-end corresponding regions in the width direction.

15. The press belt according to claim 14, wherein both opposed sidewall surfaces of said recessed part are tapered so that a distance between them is reduced toward a lower side.

16. The press belt according to claim 14, wherein said reinforcing layer comprises a woven cloth.

17. The press belt according to claim 14, wherein many drainage grooves extending along a travel direction of the belt are formed in the outer peripheral surface of said upper elastic layer.

18. The press belt according to claim 17, wherein a bottom surface of said recessed part is at the same level as or deeper than a bottom end of said drainage groove.

* * * * *